US008468718B2

(12) United States Patent
Favret et al.

(10) Patent No.: US 8,468,718 B2
(45) Date of Patent: Jun. 25, 2013

(54) HOME LAUNDRY DRIER

(75) Inventors: Ugo Favret, Casarsa (IT); Flavio Noviello, Aviano (IT)

(73) Assignee: Electrolux Home Products Corporation N.V., Brussels (BE)

( * ) Notice: Subject to any disclaimer, the term of this patent is extended or adjusted under 35 U.S.C. 154(b) by 289 days.

(21) Appl. No.: 13/063,643

(22) PCT Filed: Jun. 19, 2009

(86) PCT No.: PCT/EP2009/004438
§ 371 (c)(1),
(2), (4) Date: Mar. 11, 2011

(87) PCT Pub. No.: WO2010/028709
PCT Pub. Date: Mar. 18, 2010

(65) Prior Publication Data

US 2011/0167664 A1 Jul. 14, 2011

(30) Foreign Application Priority Data

Sep. 12, 2008 (EP) ..... 08164308

(51) Int. Cl.
*F26B 11/02* (2006.01)

(52) U.S. Cl.
USPC ..... 34/601; 34/605; 34/607; 8/137; 8/142; 510/285; 134/34; 68/5 C; 68/12.23

(58) Field of Classification Search
USPC ..... 34/134, 601, 604, 605, 606, 607, 34/609, 610; 8/137, 142; 510/281, 285, 286; 134/34; 68/5 C, 12.23
See application file for complete search history.

(56) References Cited

U.S. PATENT DOCUMENTS 1,453,967 A * 5/1923 Angelus ..... 68/7
3,475,828 A * 11/1969 Moscowitz et al. ..... 34/443

(Continued)

FOREIGN PATENT DOCUMENTS

DE 3408136 9/1985
EP 1 441 060 7/2004

(Continued)

OTHER PUBLICATIONS

International Search Report issued Aug. 6, 2009 in corresponding PCT/EP2009/004438.

*Primary Examiner* — Stephen M. Gravini
(74) *Attorney, Agent, or Firm* — Banner & Witcoff, Ltd

(57) ABSTRACT

A home laundry drier (1) comprising an outer box casing (2) and, inside the casing, a laundry drying container (3) for housing the laundry to be dried, a hot-air generator (7) for circulating a stream of hot air inside said laundry drying container (3), and a steam generator (20) for feeding steam into said laundry drying container (3); the steam generator (20) comprising a steam-generating boiler (21) designed to receive water and convert it into a stream of low-pressure steam whose pressure is higher than external pressure, a steam injection nozzle (22) structured for projecting jets of low-pressure steam directly inside the laundry drying container (3), and a steam exhaust manifold (23) connecting the outlet of the steam-generating boiler (21) to the steam injection nozzle (22) for feeding the low-pressure steam produced by the steam-generating boiler (21) directly to said steam injection nozzle (22); the steam injection nozzle (22) being located over the steam-generating boiler (21), and said steam exhaust manifold (23) being dimensioned so that the maximum speed ($V_0$) of the low-pressure steam flowing along at least one portion of said steam exhaust manifold (23) is lower than 9 m/s, so to cause the natural flowing of the water droplets resulting from steam condensation inside the steam exhaust manifold (23) back to the outlet of the steam-generating boiler (21).

11 Claims, 1 Drawing Sheet

U.S. PATENT DOCUMENTS

| | | | | | |
|---|---|---|---|---|---|
| 3,805,561 | A * | 4/1974 | Bullock | 68/5 C |
| 3,861,179 | A * | 1/1975 | Orchard | 68/6 |
| 5,305,484 | A * | 4/1994 | Fitzpatrick et al. | 8/149.3 |
| 5,561,880 | A * | 10/1996 | Allen et al. | 8/149.3 |
| 6,427,365 | B2 * | 8/2002 | MacGregor et al. | 38/1 A |
| 6,622,529 | B1 * | 9/2003 | Crane | 68/5 C |
| 6,928,745 | B2 * | 8/2005 | Lickiss et al. | 34/104 |
| D553,310 | S * | 10/2007 | Penney et al. | D32/8 |
| 7,997,006 | B2 * | 8/2011 | Son et al. | 34/381 |
| 8,082,678 | B2 * | 12/2011 | Paruzzolo et al. | 34/73 |
| 8,104,191 | B2 * | 1/2012 | Ricklefs et al. | 34/474 |
| 8,146,390 | B2 * | 4/2012 | Moon et al. | 68/5 C |
| 8,151,495 | B2 * | 4/2012 | Kim et al. | 38/14 |
| 8,166,667 | B1 * | 5/2012 | Lora | 34/202 |
| 8,210,004 | B2 * | 7/2012 | Mcmillan | 68/5 C |
| 8,286,452 | B2 * | 10/2012 | Kendall et al. | 68/3 R |
| 8,375,750 | B2 * | 2/2013 | Kendall et al. | 68/3 R |
| 2004/0129032 | A1 | 7/2004 | Severns et al. | |
| 2011/0167664 | A1 * | 7/2011 | Favret et al. | 34/134 |

FOREIGN PATENT DOCUMENTS

| | | | |
|---|---|---|---|
| EP | 1 852 541 | | 11/2007 |
| EP | 1 923 499 | | 5/2008 |
| EP | 2042643 | A1 * | 4/2009 |
| EP | 2163682 | A1 * | 3/2010 |
| JP | 05177094 | A * | 7/1993 |
| JP | 09122398 | A * | 5/1997 |
| JP | 2005124763 | A * | 5/2005 |

* cited by examiner

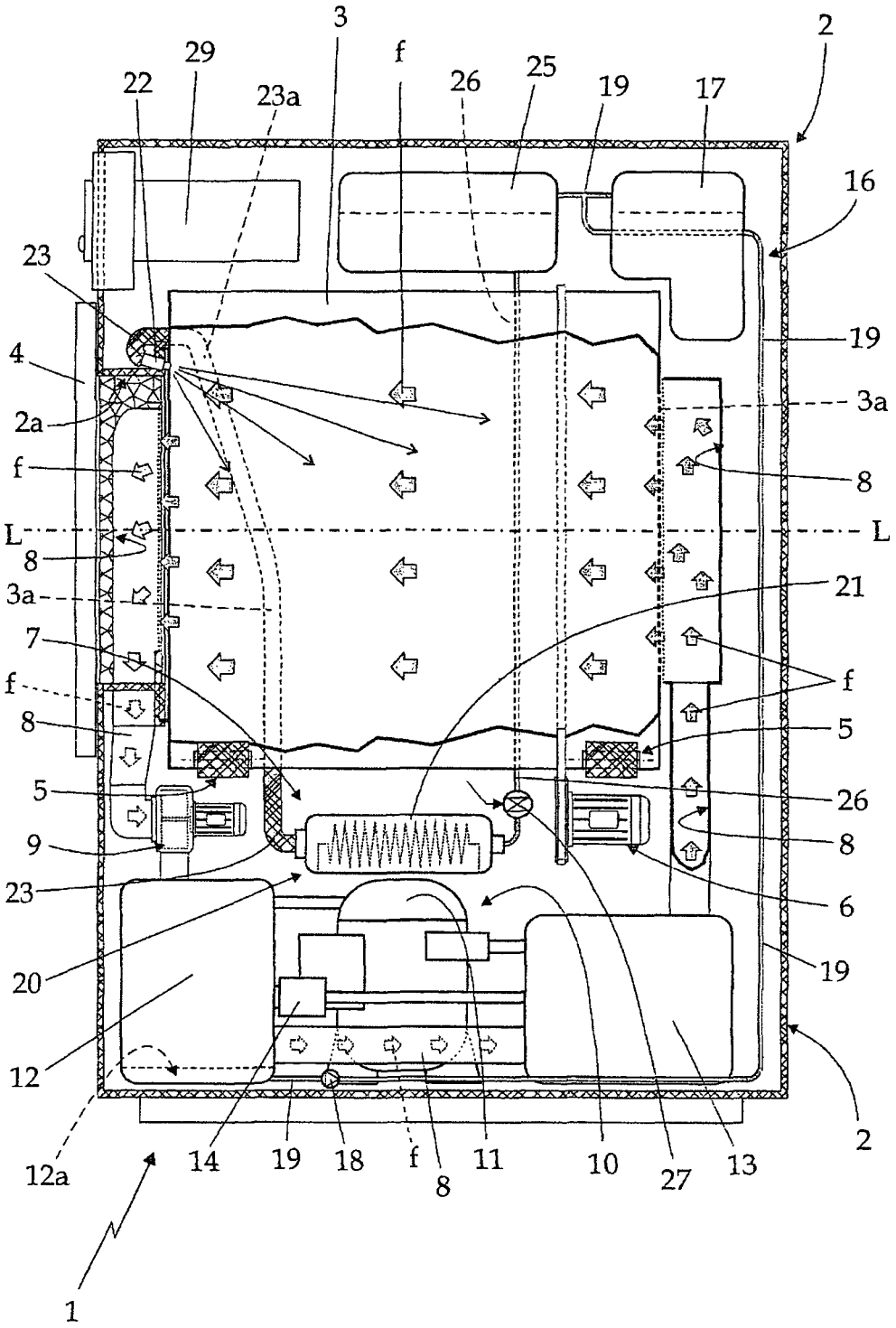
3
2
29
f
22
23a
26
25
19
17
16
23
19
4
3a
2a
8
f
L
L
8
21
3a
7
f
f
8
5
5
26
9
8
23
6
20
19
12
2
12a
14
19
18
f
8
11
10
27
13
1

HOME LAUNDRY DRIER

BACKGROUND OF THE INVENTION

The present invention relates to a home laundry drier.

More specifically, the present invention relates to a rotary-drum home laundry drier with steam generator, to which the following description refers purely by way of example.

As is known, present rotary-drum home laundry driers generally comprise a substantially parallelepiped-shaped outer box casing; a cylindrical bell-shaped drum for housing the laundry to be dried, and which is housed in axially rotating manner inside the casing to rotate about its horizontally oriented longitudinal axis, directly facing a laundry loading and unloading opening formed in the front face of the casing; a door hinged to the front face of the casing to rotate to and from a closing position in which the door rests completely against the casing to close the opening in the front face of the casing and seal the revolving drum; and an electric motor assembly for rotating the drum about its longitudinal axis inside the casing.

Rotary-drum home laundry driers of the above type also comprise a closed-circuit, hot-air generator designed to circulate inside the revolving drum a stream of hot air with a low moisture content, and which flows through the revolving drum and over the laundry inside the drum to rapidly dry the laundry.

In the most widely marketed driers, the closed-circuit, hot-air generator comprises an air/air heat exchanger and an electric heater located one after the other along an air recirculating conduit, the two ends of which are connected to the revolving drum, on opposite sides of the latter; and an electric centrifugal fan or similar located along recirculating conduit to produce, inside the recirculating conduit, an airflow which flows through the revolving drum. The air/air heat exchanger provides for rapidly cooling the airflow from the revolving drum to condense the surplus moisture in the airflow; and the heater provides for rapidly heating the airflow from the heat exchanger back to the revolving drum, so that the air flowing into the drum is rapidly heated to a temperature higher than or equal to that of the same air flowing out of the revolving drum.

Some more recently marketed rotary-drum driers also feature a pressurized-steam generator which, at the end of the drying cycle, feeds a jet of steam into the revolving drum to eliminate or at least greatly reduce wrinkling of the fabrics produced during the drying cycle.

Currently used steam generators have substantially the same structure as ordinary irons with a separated boiler, and comprise a demineralized-water reservoir housed in the highest part of the household appliance casing for easy manual refill with distilled/demineralized-water; and an electric steam-generating boiler normally located below the demineralized-water reservoir and connected to it by a suitable connecting pipe. Water flows by gravity into the electric boiler under control of an electrovalve or similar placed along the connecting pipe.

Finally, the pressurized-steam generator comprises a steam injection nozzle which is located inside the casing, faced to the inside of the revolving drum, and is structured for projecting jets of low-pressure steam towards the laundry inside the revolving drum; and a steam exhaust manifold connecting the outlet of the electric steam-generating boiler to the steam injection nozzle for channeling the low-pressure steam produced by the boiler directly to the nozzle.

Since part of the low-pressure steam produced by the electric steam-generating boiler condenses while flowing along the steam exhaust manifold, the pressurized-steam generator is also provided with a water/steam separating chamber which is located along the steam exhaust manifold, immediately upstream of the steam injection nozzle, and is structured to restrain the condensed-water droplets swept by the stream of low-pressure steam along the steam exhaust manifold towards the nozzle; and with a siphon-shaped drain pipe connecting the water/steam separating chamber to a condensed-water canister located on the bottom of the cabinet, for channeling the condensed-water entrapped into the water/steam separating chamber to the condensed-water canister.

SUMMARY OF SELECTED INVENTIVE ASPECTS

It is an aim of the present invention to simplify the structure of the pressurized-steam generator for reducing production costs of today's rotary-drum home laundry driers.

According to the present invention, there is provided a home laundry drier, as claimed in claim 1 and preferably, though not necessarily, in any one of the dependent Claims.

BRIEF DESCRIPTION OF THE DRAWING

The present invention will now be described with reference to the attached drawing, which shows a schematic side view, with parts in section and parts removed for clarity, of a home laundry drier in accordance with the teachings of the present invention.

DETAILED DESCRIPTION OF EXAMPLE EMBODIMENTS

With reference to the attached drawing, number 1 indicates as a whole a home laundry drier comprising a preferably, though not necessarily, parallelepiped-shaped outer box casing 2; a preferably, though not necessarily, cylindrical, bell-shaped revolving drum 3 for housing the laundry to be dried, and which is fixed in axially rotating manner inside casing 2, directly facing a laundry loading and unloading opening 2*a* formed in the front face of casing 2; and a door 4 hinged to the front face of casing 2 to rotate to and from a closing position in which door 4 rests completely against the casing to close opening 2*a* in the front face of the casing to seal revolving drum 3.

More specifically, in the example shown revolving drum 3 rests horizontally inside casing 2 on a number of horizontal supporting rollers 5 which are fitted to casing 2 to let revolving drum 3 freely rotate about its longitudinal axis L.

Casing 2, revolving drum 3, door 4 and supporting rollers 5 are commonly known parts in the industry, and therefore not described in detail.

With reference to the attached drawing, laundry drier 1 also comprises a motor assembly 6 for rotating, on command, revolving drum 3 about its longitudinal axis L inside casing 2; and a closed-circuit, hot-air generator 7 housed inside casing 2 and designed to circulate through revolving drum 3 a stream of hot air having a low moisture level, and which flows over and rapidly dries the laundry inside drum 3.

More specifically, closed-circuit, hot-air generator 7 provides for gradually drawing air from revolving drum 3; extracting surplus moisture from the hot air drawn from revolving drum 3; heating the dehumidified air to a predetermined temperature, normally higher than the temperature of the air from revolving drum 3; and feeding the heated, dehumidified air back into revolving drum 3, where it flows over, to rapidly dry, the laundry inside the drum.

In other words, hot-air generator 7 provides for continually dehumidifying and heating the air circulating inside revolving drum 3 to rapidly dry the laundry inside the drum, and substantially comprises:

an air recirculating conduit 8, the two ends of which are connected to revolving drum 3 on opposite sides of the latter;

an electrically powered centrifugal fan 9, or other type of air circulating pump, located along recirculating conduit 8 to produce, inside recirculating conduit 8, an airflow f which flows into revolving drum 3 and over the laundry inside drum 3; and a heat-pump assembly 10 which is able to rapidly cool the airflow f coming out from revolving drum 3 for condensing the surplus moisture in the airflow f, and then to rapidly heat the airflow f returning back into revolving drum 3, so that the airflow entering into revolving drum 3 is heated rapidly to a temperature higher than or equal to that of the same air flowing out of the drum.

More specifically, in the example shown the intake end of recirculating conduit 8 is integrated in door 4, and is faced to the front opening of revolving drum 3; the end wall 3*a* of revolving drum 3 is perforated, or at any rate permeable to air, to permit air entry into drum 3; and the exhaust end of recirculating conduit 8 is coupled in airtight manner directly to the end wall 3*a* of revolving drum 3.

As regards electric centrifugal fan 9, it is structured to produce an airflow f flowing, along recirculating conduit 8, from the intake end of recirculating conduit 8, i.e. door 4, to the exhaust end of recirculating conduit 8, i.e. perforated end wall 3*a* of revolving drum 3.

With reference to the attached drawing, heat-pump assembly 10 operates in the same way as a traditional heat-pump—which is capable of transferring heat from one fluid to another using an intermediate gaseous refrigerant subjected to a closed thermodynamic cycle, the thermodynamic principles of which are widely known and therefore not described in detail—and comprises:

an electrically powered refrigerant compressing device 11 which subjects a gaseous refrigerant to compression (e.g. adiabatic compression) so that refrigerant pressure and temperature are much higher at the outlet than at the inlet of compressing device 11;

a first air/refrigerant heat exchanger 12 which is located along recirculating conduit 8—preferably, thought not necessarily, downstream of centrifugal fan 9—and is designed so that the airflow f from revolving drum 3 and the refrigerant flowing to the inlet of compressing device 11 flow through it simultaneously, allowing the refrigerant having a temperature lower than that of the airflow f, to absorb heat from the airflow f thus causing condensation of the surplus moisture in the airflow f;

a second air/refrigerant heat exchanger 13 which is located along recirculating conduit 8, downstream of air/refrigerant heat exchanger 12, and is designed so that the airflow f directed to revolving drum 3 and the refrigerant from the outlet of compressing device 11 flow through it simultaneously, allowing the refrigerant having a temperature greater than that of the airflow f to release heat to the airflow f, thus rapidly heating the airflow f to a temperature higher than of the airflow f coming out of the air/refrigerant heat exchanger 12, and preferably, thought not necessarily, also higher or equal to the temperature of the airflow f coming out of revolving drum 3; and a throttling valve or similar refrigerant expansion device which subjects the refrigerant flowing from the second air/refrigerant heat exchanger 13 to the first air/refrigerant heat exchanger 12 to a rapid expansion, so that pressure and temperature of the refrigerant entering in air/refrigerant heat exchanger 12 are much lower than pressure and temperature of the refrigerant coming out from air/refrigerant heat exchanger 13, thus completing the closed thermodynamic cycle in opposition to the compressing device 11, which provides for rapidly compressing the refrigerant.

Heat-pump assembly 10 finally comprises a number of suitable connecting pipes which connect refrigerant compressing device 11, air/refrigerant heat exchanger 12, air/refrigerant heat exchanger 13 and refrigerant expansion device 14 one to the other, so as to form a closed circuit allowing the refrigerant coming out from the outlet of compressing device 11 to flow, in sequence, through heat exchanger 13, refrigerant expansion device 14 and heat exchanger 12, before returning to the inlet of compressing device 11.

Like known home laundry driers, air/refrigerant heat exchanger 12 is provided with a condensed-water canister 12*a* which collects the liquid distilled water produced, when the drier is running, inside heat exchanger 12 by condensation of the surplus moisture in airflow f arriving from revolving tub 3; and hot-air generator 7 also comprises a water drain circuit 16 for draining, on command, the distilled water from condensed-water canister 15*a*.

Preferably, though not necessarily, the water drain circuit 16 comprises a high-capacity manually-removable waste-water tank housed in easily removable manner inside casing 2, preferably, though not necessarily, near the top of the casing; and an electric pump 18 which, on command, sucks the distilled water from condensed-water canister 15 and feeds it to waste-water tank 17 via a connecting pipe 19.

With reference to the attached drawing, like recently marketed home laundry driers, laundry drier 1 is also provided with a pressurized-steam generator 20 which is housed inside casing 2 and, on command, produces and feeds a jet of steam into revolving drum 3 to eliminate or at least greatly reduce wrinkling of the fabrics produced during the drying cycle. This pressurized-steam generator 20 comprises an electric in-pressure steam-generating boiler 21 designed to receive a given quantity of water and immediately convert it into a stream of low-pressure steam whose pressure is higher than external pressure; at least one steam injection nozzle 22 (only one in the example shown) located inside casing 2, preferably, thought not necessarily, in the collar connecting the front opening of revolving drum 3 to opening 2*a* in the front face of casing 2, and structured for projecting jets of low-pressure steam directly inside revolving drum 3; and a steam exhaust manifold 23 connecting the outlet of steam-generating boiler 21 to steam injection nozzle/s 22 for feeding the low-pressure steam produced by boiler 21 directly to nozzle/s 22.

More specifically, steam-generating boiler 21 is preferably, thought not necessarily, located near the bottom of casing 2, steam injection nozzle/s 22 is/are located over boiler 21, and steam exhaust manifold 23 has at least one length extending substantially vertically inside casing 2.

Unlike known laundry driers with pressurized-steam generator, in laundry drier 1 the steam exhaust manifold 23 is dimensioned so that maximum speed of the low-pressure steam flowing along at least one portion 23*a* of the steam exhaust manifold 23, is lower than 9 m/s (meters per seconds) so to cause the natural flowing of the water droplets resulting from steam condensation inside manifold 23 back to the outlet of steam-generating boiler 21.

More specifically, in the example shown steam exhaust manifold 23 is dimensioned so that the maximum speed of the low-pressure steam flowing along portion 23*a* of the steam exhaust manifold 23, is preferably, thought not necessarily, lower than 8.5 m/s (meters per second).

In addition to the above, portion 23*a* of steam exhaust manifold 23 is preferably, thought not necessarily, located immediately upstream of steam injection nozzle 22 and extends inside casing 2 substantially vertically.

Several tests in the field revealed that the stream of low-pressure steam, when flowing along portion 23*a* of manifold 23 with a maximum speed preferably, thought not necessarily, lower than 8.5 m/s, and in any case lower than 9 m/s, is unable to sweep the condensed-water droplets resulting from steam condensation along manifold 23, up to nozzle 22, because the floating force generated on condensed-water droplets by the stream of low-pressure steam flowing along manifold 23 does not overcame the force of gravity acting on the same condensed-water droplets.

In view of the above, the water droplets resulting from steam condensation inside manifold 23 tend to accumulate at the outlet of steam-generating boiler 21, and go back into steam-generating boiler 21 when steam-generating boiler 21 is switched off at the end of the drying cycle, for being vaporized again later on.

Minimum cross section area $S_{min}$ of portion 23*a* of steam exhaust manifold 23 may be determined on the basis of the following two-equation system:

$$S_{min}=Q_{steam}/V_0$$

$$Q_{steam}=P_{steam}/d_{steam}$$

where $V_0$ is the maximum speed (8.5 m/s or even 9 m/s) accepted for the low-pressure steam flowing along portion 23*a* of manifold 23; $Q_{steam}$ is the volume of steam per time-unit coming out from the outlet of steam-generating boiler 21; $P_{steam}$ is the mass of steam per time-unit coming out from the outlet of steam-generating boiler 21; and $d_{steam}$ is the density of the steam inside manifold 23, and is approximately equal to 0.6 kg/m$^3$ (kilos per cubic meter).

More specifically, assuming that steam-generating boiler 21 produces a nominal mass of steam per time-unit $P_{steam}$ equals to 0.035 Kg/min (kilos per minute) and that the maximum speed $V_0$ of the low-pressure steam flowing along manifold 23 is set to 8.5 m/s (meters per second), the nominal volume of steam per time-unit $Q_{steam}$ coming out from steam-generating boiler 21 is approximately equal to $9.7\cdot10^{-4}$ m$^3$/s (cubic meters per second). Thus the minimum cross section area $S_{min}$ of manifold 23 should be roughly equal to $1.143\cdot10^{-4}$ m$^2$ (square meters).

In the example shown, steam exhaust manifold 23 is a hosepipe 23 having preferably, thought not necessarily, a circular cross section, thus nominal diameter of hosepipe 23 should be roughly equal to 12 mm (millimeters).

In addition to the above, with reference to the attached drawing, pressurized-steam generator 20 preferably, thought not necessarily, comprises also a demineralized-water reservoir 25 which is housed inside casing 2, over steam-generating boiler 21, and is connected to steam-generating boiler 21 via a suitable connecting pipe 26; and an electrically operated valve or pump 27 which is located along connecting pipe 26 to control the outflow of water from water reservoir 25 to steam-generating boiler 21.

Obviously, water flows by gravity from water reservoir 25 to steam-generating boiler 21.

Electric steam-generating boiler 21, steam injection nozzle 22, demineralized-water reservoir 25 and electrically operated valve or pump 27 are commonly known parts in the industry, and therefore not described in detail.

In the example shown, to avoid or greatly reduce manual refilling with demineralized water, demineralized-water reservoir 25 of pressurized-steam generator 20 is preferably, thought not necessarily, connected to the water drain circuit 16 of hot-air generator 7, to receive part of the condensed water drained from the condensed-water canister 12*a* of air/refrigerant heat exchanger 12.

Like any other recently marketed electric household appliance, laundry drier 1 is finally provided with an electronic central control unit 29, which controls the electric motor of motor assembly 6 and both centrifugal fan 9 and refrigerant compressing device 11 of hot-air generator 7 in a predetermined manner, as memorized inside it, to perform the user-selected drying cycle.

In addition to the above, control unit 29 also controls pressurized-steam generator 20 (i.e. steam-generating boiler 21 and electrically operated valve or pump 27) in predetermined manner, as memorized inside it, to feed jets of low-pressure steam into revolving drum 3 when required by the user-selected drying cycle.

General operation of laundry drier 1 is clearly inferable from the above description, with no further explanation required.

The advantages connected to the particular dimensioning of steam exhaust manifold 23 are obvious: keeping below 8.5 m/s (or even 9 m/s) the maximum speed of the low-pressure steam flowing along the substantially vertical portion 23*a* of the steam exhaust manifold 23, prevents condensed-water droplets resulting from steam condensation inside manifold 23 from reaching the steam injection nozzle 22 at top of manifold 23, and causes the natural flowing back of these condensed-water droplets to the outlet of steam-generating boiler 21.

Thus, thanks to the particular dimensioning of steam exhaust manifold 23, the pressurized-steam generator of the home laundry drier is no more provided with a water/steam separating chamber, and with a syphon-shaped drain pipe connecting the water/steam separating chamber to a condensed-water canister located on the bottom of the cabinet, thus reducing overall production costs of the household appliance.

In addition to the above, when steam-generating boiler 21 is switched off, the condensed-water droplets resulting from steam condensation inside manifold 23 go back into steam-generating boiler 21 for being vaporized again later on, therefore water consumption of pressurized-steam generator 20 is considerably lower than that of a traditional pressurized-steam generator provided with the water/steam separating chamber and the syphon-shaped drain pipe. In other words, pressurized-steam generator 20 requires a less frequent manual refilling of water reservoir 25.

Clearly, changes may be made to home laundry drier 1 as described herein without, however, departing from the scope of the present invention.

For example, heat-pump assembly 10 of hot-air generator 7 may be replaced by an air/air heat exchanger and by an electric heater (for example, a resistor) located one after the other along air recirculating conduit 8. The air/air heat exchanger provides for rapidly cooling the airflow f arriving from revolving drum 3 to condense the surplus moisture in the airflow f; and the electric heater provides for rapidly heating the airflow f directed back to revolving drum 3 so that the air flowing into the drum is rapidly heated to a temperature higher than or equal to that of the same air flowing out of revolving drum 3.

The invention claimed is:

1. A home laundry drier comprising an outer box casing and, inside the casing, a laundry drying container for housing the laundry to be dried, and a steam generator for feeding steam into said laundry drying container; the steam generator comprising a steam-generating boiler designed to receive water and convert it into a stream of low-pressure steam whose pressure is higher than external pressure, at least one steam injection nozzle structured for projecting jets of low-pressure steam directly inside the laundry drying container, and a steam exhaust manifold connecting the outlet of the steam-generating boiler to the steam injection nozzle for feeding the low-pressure steam produced by the steam-generating boiler directly to said steam injection nozzle; the steam injection nozzle being located over the steam-generating boiler, wherein said steam exhaust manifold is dimensioned so that the maximum speed of the low-pressure steam flowing along at least one portion of said steam exhaust manifold is lower than 9 m/s, so to cause the natural flowing of the water droplets resulting from steam condensation inside the steam exhaust manifold back to the outlet of the steam-generating boiler.

2. A home laundry drier as claimed in claim 1, wherein the maximum speed of the low-pressure steam flowing along said at least one portion of the steam exhaust manifold is lower than 8.5 m/s.

3. A home laundry drier as claimed in claim 1, wherein said at least one portion of the steam exhaust manifold extends substantially vertically.

4. A home laundry drier as claimed in claim 3, wherein said at least one portion of the steam exhaust manifold is located immediately upstream of the steam injection nozzle.

5. A home laundry drier as claimed in claim 1, wherein said steam generator also comprises a water reservoir connected to said steam-generating boiler via a suitable connecting pipe, and flow regulating means located along the connecting pipe to control the outflow of water from the water reservoir to the steam-generating boiler.

6. A home laundry drier as claimed in claim 1, further comprising, inside the casing, a hot-air generator for circulating a stream of hot air inside the laundry drying container.

7. A home laundry drier as claimed in claim 6, wherein said hot-air generator comprises an air recirculating conduit connected at both ends to said laundry drying container; ventilating means able to produce, along the recirculating conduit, an airflow which flows through the laundry drying container; air cooling means located along the air recirculating conduit for cooling the airflow arriving from the laundry drying container and causing condensation of the surplus moisture in said airflow; and air heating means located along the air recirculating conduit, downstream of said air cooling means, for rapidly heating the airflow returning back into the laundry drying container.

8. A home laundry drier as claimed in claim 7, wherein said air cooling means comprises a condensed-water canister for collecting the liquid distilled water produced, when the drier is running, inside said air cooling means; the hot-air generator also comprising a water drain circuit for draining, on command, the condensed water from said condensed-water canister.

9. A home laundry drier as claimed in claim 8, wherein said water drain circuit comprises a manually-removable waste-water tank housed in easily removable manner inside the casing; and a pump which sucks the condensed water from said condensed-water canister and feeds said condensed water to said waste-water tank.

10. A home laundry drier as claimed in claim 8, wherein the water reservoir of said steam generator is connected to the water drain circuit of said hot-air generator, to receive at least part of the condensed water drained from the condensed-water canister of said air cooling means.

11. A home laundry drier as claimed in claim 1, wherein said laundry drying container is a substantially cylindrical bell-shaped drum fixed in axially rotating manner inside the outer box casing of the drier.

* * * * *